US011987434B2

(12) United States Patent
Garnier et al.

(10) Patent No.: US 11,987,434 B2
(45) Date of Patent: May 21, 2024

(54) ARTICLE CARRIER AND BLANK THEREFOR

(71) Applicant: WestRock Packaging Systems, LLC, Atlanta, GA (US)

(72) Inventors: Jean-Michel Garnier, Issoudun (FR); Matthew E. Zacherle, Chesterfield, VA (US)

(73) Assignee: WestRock Packaging Systems, LLC, Atlanta, GA (US)

( * ) Notice: Subject to any disclaimer, the term of this patent is extended or adjusted under 35 U.S.C. 154(b) by 0 days.

(21) Appl. No.: 17/910,131

(22) PCT Filed: Mar. 9, 2021

(86) PCT No.: PCT/US2021/021489

§ 371 (c)(1),
(2) Date: Sep. 8, 2022

(87) PCT Pub. No.: WO2021/183500

PCT Pub. Date: Sep. 16, 2021

(65) Prior Publication Data

US 2023/0101163 A1 Mar. 30, 2023

Related U.S. Application Data

(60) Provisional application No. 62/988,142, filed on Mar. 11, 2020.

(51) Int. Cl.
*B65D 71/42* (2006.01)

(52) U.S. Cl.
CPC ..... *B65D 71/42* (2013.01); *B65D 2571/0066* (2013.01)

(58) Field of Classification Search
CPC ..... B65D 71/42; B65D 71/44; B65D 71/50; B65D 2571/00444; B65D 2571/0066; B65D 2571/00771
(Continued)

(56) References Cited

U.S. PATENT DOCUMENTS 5,188,225 A * 2/1993 Jorba ..... B65D 71/46 206/148
10,836,550 B2 * 11/2020 Zacherle ..... B65D 71/44
2018/0222650 A1 8/2018 Zacherle

FOREIGN PATENT DOCUMENTS

EP 2067713 A1 6/2009
WO 2013/106800 A1 7/2013

OTHER PUBLICATIONS

International Search Report issued in PCT/US2021/021489, dated Oct. 4, 2021 (5 pages).

* cited by examiner

*Primary Examiner* — Bryon P Gehman
(74) *Attorney, Agent, or Firm* — Brian J. Goldberg; Rohini K. Garg

(57) ABSTRACT

Aspects of the disclosure relate to an article carrier for packaging one or more articles and a blank for forming the carrier. The article carrier (90; 290) comprises a plurality of top-engaging openings or engaging structures RT1, RT2, RTS each having an annular series of engaging teeth or tabs (16; 216) along the perimeter of that opening. The annular series of engaging tabs (16; 216) of each opening is interrupted by at most two gaps (26, 26A, 26B). A notional diametrical line z-z' passes through the center of each of the at most two gaps (26, 26A, 26B) and extends substantially perpendicular to the grain direction GR of paper material from which the article carrier (90; 290) is formed.

24 Claims, 8 Drawing Sheets

(58) Field of Classification Search
USPC ..... 206/147–149, 151–153
See application file for complete search history.

FIG. 1 ⟵ GR ⟶

ARTICLE CARRIER AND BLANK THEREFOR

CROSS REFERENCE TO RELATED APPLICATION

This application is a National Stage entry of PCT Application No. PCT/US2021/02148, filed Mar. 9, 2021, which claims the benefit of U.S. Provisional Patent Application No. 62/988,142, filed Mar. 11, 2020, the disclosures of which are herein incorporated by reference in their entirety.

TECHNICAL FIELD

The present invention relates to article carriers and to blanks for forming the same. More specifically, but not exclusively, the invention relates to a carrier of the top-gripping type having one or more openings for receiving and retaining an article therein.

BACKGROUND

In the field of packaging it is known to provide cartons for carrying multiple articles. Cartons are well known in the art and are useful for enabling consumers to transport, store and access a group of articles for consumption. For cost and environmental considerations, such cartons or carriers need to be formed from as little material as possible and cause as little wastage in the materials from which they are formed as possible. Further considerations are the strength of the carton and its suitability for holding and transporting large weights of articles. It is desirable that the contents of the carton are secure within the carton.

It is well known to provide top gripping article carriers in which an aperture is formed in a panel of the carrier, wherein tabs are struck from said panel of the carrier about the aperture. The tabs are displaced out of the plane of said panel when an article is received in the aperture, wherein said tabs engage the article generally about a flange or lip of the article.

The present invention seeks to provide an improvement in the field of cartons, typically formed from paperboard or the like.

SUMMARY

A first aspect of the invention provides an article carrier for packaging at least one article. The article carrier comprises a main panel having at least one top-engaging opening for receiving a portion of an article and defined, at least in part, by an aperture struck from the main panel. The main panel comprises an annular series of engaging tabs formed around the at least one opening. The aperture defines a first edge of each of the tabs of the annular series. The tabs of the annular series are hingedly connected to the main panel such that the tabs of the annular series yield out of the plane of the main panel when an article is received in the at least one opening so as to bear against the article. At least one of the tabs of the annular series is defined at least in part by a first cutline extending from the aperture into the main panel. The first cut line separates at least a portion of the at least one of the tabs from an adjacent one of the tabs of the annular series. The main panel comprises a second cut line defining a portion of a second edge of each of said at least one tab and said adjacent tab. The second edge opposes the first edge and the second cut line is linear.

A second aspect of the invention provides an article carrier for packaging at least one article. The article carrier comprises a main panel having at least one top-engaging opening for receiving a portion of an article and defined, at least in part, by an aperture struck from the main panel. The main panel comprises an annular series of engaging tabs formed around the at least one opening. The aperture defines a first edge of each of the tabs of the annular series. The tabs of the annular series are hingedly connected to the main panel such that the tabs of the annular series yield out of the plane of the main panel when an article is received in the at least one opening so as to bear against the article. At least one of the tabs of the annular series is defined at least in part by a first cutline extending from the aperture into the main panel. The first cut line separates at least a portion of the at least one of the tabs from an adjacent one of the tabs of the annular series. The main panel comprises a second cut line defining a portion of a second edge of each of said at least one tab and said adjacent tab. The second edge opposes the first edge. The second cutline is arcuate in shape. The second cutline is defined by a radius of curvature having a center thereof coincidental with the center of the aperture.

Optionally, the at least one of the tabs of the annular series is connected to the adjacent one of the tabs by a connecting portion proximate the second cutline.

Optionally, the main panel comprises at least one third cutline spaced apart from the second cutline. The at least one third cutline defines a portion of a hinged connection between each of the at least one of the tabs of the annular series and the main panel.

Optionally, the hinged connection opposes the first edge of each of the at least one of the tabs of the annular series.

Optionally, the at least one third cutline is linear.

Optionally, the at least one third cutline is non-linear.

Optionally, the at least one third cutline is arcuate in shape.

Optionally, the at least one third cutline comprises a series of two or more cuts spaced apart from one another.

A third aspect of the invention provides an article carrier for packaging at least one article. The article carrier comprises a main panel having at least one top-engaging opening for receiving a portion of an article and defined, at least in part, by an aperture struck from the main panel. The aperture has a width dimension. The main panel comprises an annular series of engaging tabs formed around the at least one opening. The aperture defines a first edge of each of the tabs of the annular series. The tabs of the annular series are hingedly connected to the main panel such that the tabs of the annular series yield out of the plane of the main panel when an article is received in the at least one opening so as to bear against the article. At least one of the tabs of the annular series is defined, at least in part, by a first cutline extending from the aperture into the main panel. The first cut line separates at least a portion of the at least one of the tabs from an adjacent one of the tabs of the annular series. The main panel comprises a second cut line defining a portion of a second edge of each of said at least one tab and said adjacent tab. The second edge opposes the first edge. The second cutline is arcuate in shape. The second cutline is defined by a radius of curvature which is greater than half the width dimension of the aperture.

A fourth aspect of the invention provides an article carrier for packaging at least one article. The article carrier comprises a main panel having at least two top-engaging openings each for receiving a portion of an article and defined, at least in part, by a respective aperture struck from the main panel. Each of the apertures has a width dimension. The main panel comprises an annular series of engaging tabs formed around each of the at least two openings. Each of the apertures defines a first edge of each of the tabs of the respective annular series. The tabs of each of the annular series are hingedly connected to the main panel such that the tabs of the annular series yield out of the plane of the main panel when an article is received in the respective opening so as to bear against said article. At least one of the tabs of each annular series is defined, at least in part, by a first cutline extending from the respective aperture into the main panel. The first cut line separates at least a portion of the at least one of the tabs from an adjacent tab in the annular series. The main panel comprises a second cut line defining a portion of a second edge of each of said at least one tab and said adjacent tab. The second edge opposes the first edge. The second cutline is arcuate in shape. The second cutline is defined by a radius of curvature which is greater than half the width dimension of the aperture. The at least two top-engaging openings are disposed in close proximity to each other.

Optionally, the at least two top-engaging openings are spaced apart from each other by a first distance. The first distance may be less than half of the diameter of the at least two top-engaging openings.

Optionally, the at least two top-engaging openings are spaced apart from each other by a first distance. The first distance may be less than a quarter of the diameter of the at least two top-engaging openings.

Optionally, the at least two top-engaging openings are spaced apart from each other by a first distance. The first distance may be less than a fifth of the diameter of the at least two top-engaging openings.

Optionally, the at least two top-engaging openings are spaced apart from each other by a first distance. The first distance may be less than a tenth of the diameter of the at least two top-engaging openings.

Optionally, the at least two top-engaging openings are spaced apart from each other by a first distance. The first distance may be less than twice a height dimension of the tabs forming the annular series about the at least two top-engaging openings.

Optionally, the at least two top-engaging openings are spaced apart from each other by a first distance. The first distance may be less than twice a height dimension of the tabs forming the annular series about the at least two top-engaging openings.

Optionally, the at least two top-engaging openings are spaced apart from each other by a first distance. The first distance may be less than twice a radial dimension of the tabs forming the annular series about the at least two top-engaging openings.

A fifth aspect of the invention provides an article carrier for packaging at least one article. The article carrier comprises a plurality of top-engaging openings each having an annular series of engaging tabs along the perimeter thereof. The annular series of engaging tabs of each top-engaging opening is interrupted by at most two gaps. A notional diametrical line passes through the center of each of the at most two gaps and extends substantially perpendicular to the grain direction of paper material from which the article carrier is formed.

Optionally, each of the tabs of the annular series comprises occupies a first angular width and each of the at most two gaps occupies a second angular width. The second angular width may be greater than the first angular width.

Optionally, the second angular width is around twice the first angular width.

A sixth aspect of the invention provides an article carrier for packaging at least one article. The article carrier comprises a plurality of top-engaging openings each having an annular series of engaging tabs along the perimeter thereof. The annular series of engaging tabs of each opening is interrupted by at most two gaps. A notional diametrical line passes through the center of each of the at most two gaps and extends parallel to a longitudinal axis of the article carrier.

A seventh aspect of the invention provides an article carrier for packaging at least one article. The article carrier comprises a plurality of top-engaging openings each having an annular series of engaging tabs along the perimeter of that opening. A first one of the plurality of openings has only one first gap interrupting the annular series of tabs of the first opening. A second one of the plurality of openings has only two second gaps interrupting the annular series of tabs of the second opening. The first gap and each of the second gaps are aligned along a notional line parallel to a longitudinal axis of the article carrier.

An eighth aspect of the invention provides a blank for forming an article carrier. The blank comprises a main panel having at least one top-engaging opening for receiving a portion of an article and defined, at least in part, by an aperture struck from the main panel. The main panel comprises an annular series of engaging tabs formed around the at least one opening. The aperture defines a first edge of each of the tabs of the annular series. The tabs of the annular series are hingedly connected to the main panel such that the tabs of the annular series yield out of the plane of the main panel when an article is received in the at least one opening so as to bear against the article. At least one of the tabs of the annular series is defined, at least in part, by a first cutline extending from the aperture into the main panel. The first cut line separates at least a portion of the at least one of the tabs from an adjacent one of the tabs of the annular series. The main panel comprises a second cut line defining a portion of a second edge of each of said at least one tab and said adjacent tab. The second edge opposes the first edge. The second cut line is linear.

A ninth aspect of the invention provides a blank for forming an article carrier. The blank comprises a main panel having at least one top-engaging opening for receiving a portion of an article and defined, at least in part, by an aperture struck from the main panel. The main panel comprises an annular series of engaging tabs formed around the at least one opening. The aperture defines a first edge of each of the tabs of the annular series. The tabs of the annular series are hingedly connected to the main panel such that the tabs of the annular series yield out of the plane of the main panel when an article is received in the at least one opening so as to bear against the article. At least one of the tabs of the annular series is defined, at least in part, by a first cutline extending from the aperture into the main panel. The first cut line separates at least a portion of the at least one of the tabs from an adjacent one of the tabs of the annular series. The main panel comprises a second cut line defining a portion of a second edge of each of said at least one tab and said adjacent tab. The second edge opposes the first edge. The second cutline is arcuate in shape. The second cutline is defined by a radius of curvature having a center thereof, which center is coincidental with the center of the aperture.

A tenth aspect of the invention provides a blank for forming an article carrier. The blank comprises a main panel including a main panel having at least one top-engaging opening for receiving a portion of an article and defined at least in part by an aperture struck from the main panel. The aperture has a width dimension. The main panel comprises an annular series of engaging tabs formed around the at least one opening. The aperture defines a first edge of each of the tabs of the annular series. The tabs of the annular series are hingedly connected to the main panel such that the tabs of the annular series yield out of the plane of the main panel when an article is received in the at least one opening so as to bear against the article. At least one of the tabs of the annular series is defined at least in part by a first cutline extending from the aperture into the main panel. The first cut line separates at least a portion of the at least one of the tabs from an adjacent one of the tabs of the annular series. The main panel comprises a second cut line defining a portion of a second edge of each of said at least one tab and said adjacent tab. The second edge opposes the first edge. The second cutline is arcuate in shape. The second cutline is defined by a radius of curvature which is greater than half the width dimension of the aperture.

An eleventh aspect of the invention provides a blank for forming an article carrier. The blank comprises a main panel comprising a plurality of top-engaging openings each having an annular series of engaging tabs along the perimeter thereof. The annular series of engaging tabs of each top-engaging opening is interrupted by at most two gaps. A notional diametrical line passes through the center of each of the at most two gaps and extends substantially perpendicular to the grain direction of paper material from which the blank is formed.

A twelfth aspect of the invention provides a blank for forming an article carrier. The blank comprises a main panel comprising a plurality of top-engaging openings each having an annular series of engaging tabs along the perimeter thereof. The annular series of engaging tabs of each opening is interrupted by at most two gaps. A notional diametrical line passes through the center of each of the at most two gaps and extends parallel to a longitudinal axis of the blank.

A thirteenth aspect of the invention provides a blank for forming an article carrier. The blank comprises a main panel comprising a plurality of top-engaging openings each having an annular series of engaging tabs along the perimeter of that opening. A first one of the plurality of openings has only one first gap interrupting the annular series of tabs of the first opening. A second one of the plurality of openings has only two second gaps interrupting the annular series of tabs of the second opening. The first gap and each of the second gaps are aligned along a notional line parallel to a longitudinal axis of the blank.

Within the scope of this application it is envisaged or intended that the various aspects, embodiments, examples, features and alternatives set out in the preceding paragraphs, in the claims and/or in the following description and drawings may be considered or taken independently or in any combination thereof.

Features or elements described in connection with, or relation to, one embodiment are applicable to all embodiments unless there is an incompatibility of features. One or more features or elements from one embodiment may be incorporated into, or combined with, any of the other embodiments disclosed herein, said features or elements extracted from said one embodiment may be included in addition to, or in replacement of one or more features or elements of said other embodiment.

A feature, or combination of features, of an embodiment disclosed herein may be extracted in isolation from other features of that embodiment. Alternatively, a feature, or combination of features, of an embodiment may be omitted from that embodiment.

BRIEF DESCRIPTION OF THE DRAWINGS

Exemplary embodiments of the present disclosure will now be described with reference to the accompanying drawings, in which.

DETAILED DESCRIPTION OF EMBODIMENTS

Detailed descriptions of specific embodiments of the package, blanks and carriers are disclosed herein. It will be understood that the disclosed embodiments are merely examples of the way in which certain aspects of the invention can be implemented and do not represent an exhaustive list of all of the ways the invention may be embodied. As used herein, the word "exemplary" is used expansively to refer to embodiments that serve as illustrations, specimens, models, or patterns. Indeed, it will be understood that the packages, blanks and carriers described herein may be embodied in various and alternative forms. The Figures are not necessarily to scale and some features may be exaggerated or minimized to show details of particular components. Well-known components, materials or methods are not necessarily described in great detail in order to avoid obscuring the present disclosure. Any specific structural and functional details disclosed herein are not to be interpreted as limiting, but merely as a basis for the claims and as a representative basis for teaching one skilled in the art to variously employ the invention.

Figure 1:
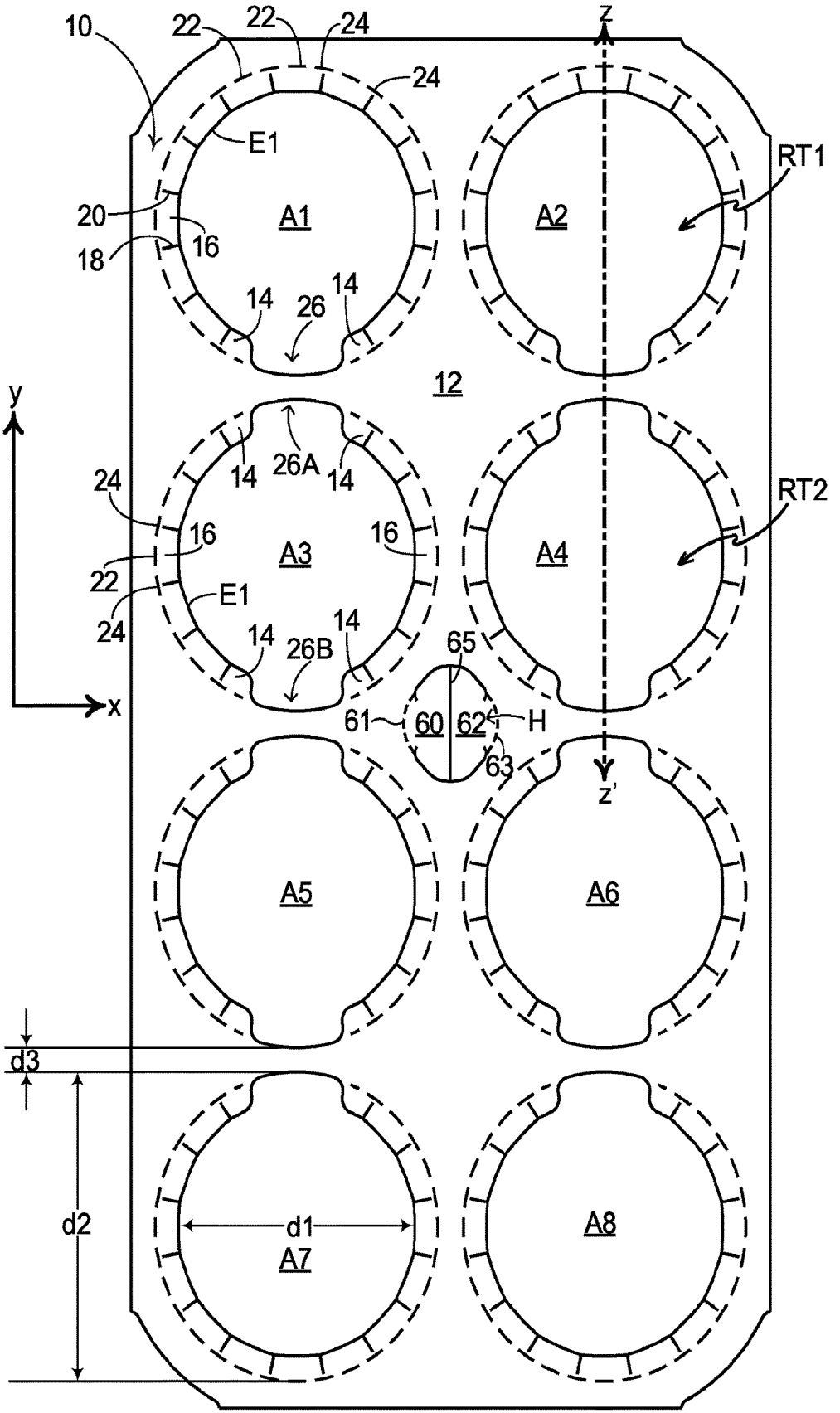
FIG. 1 is a plan view from above of a blank for forming a carrier according to a first embodiment.
Figure 2:
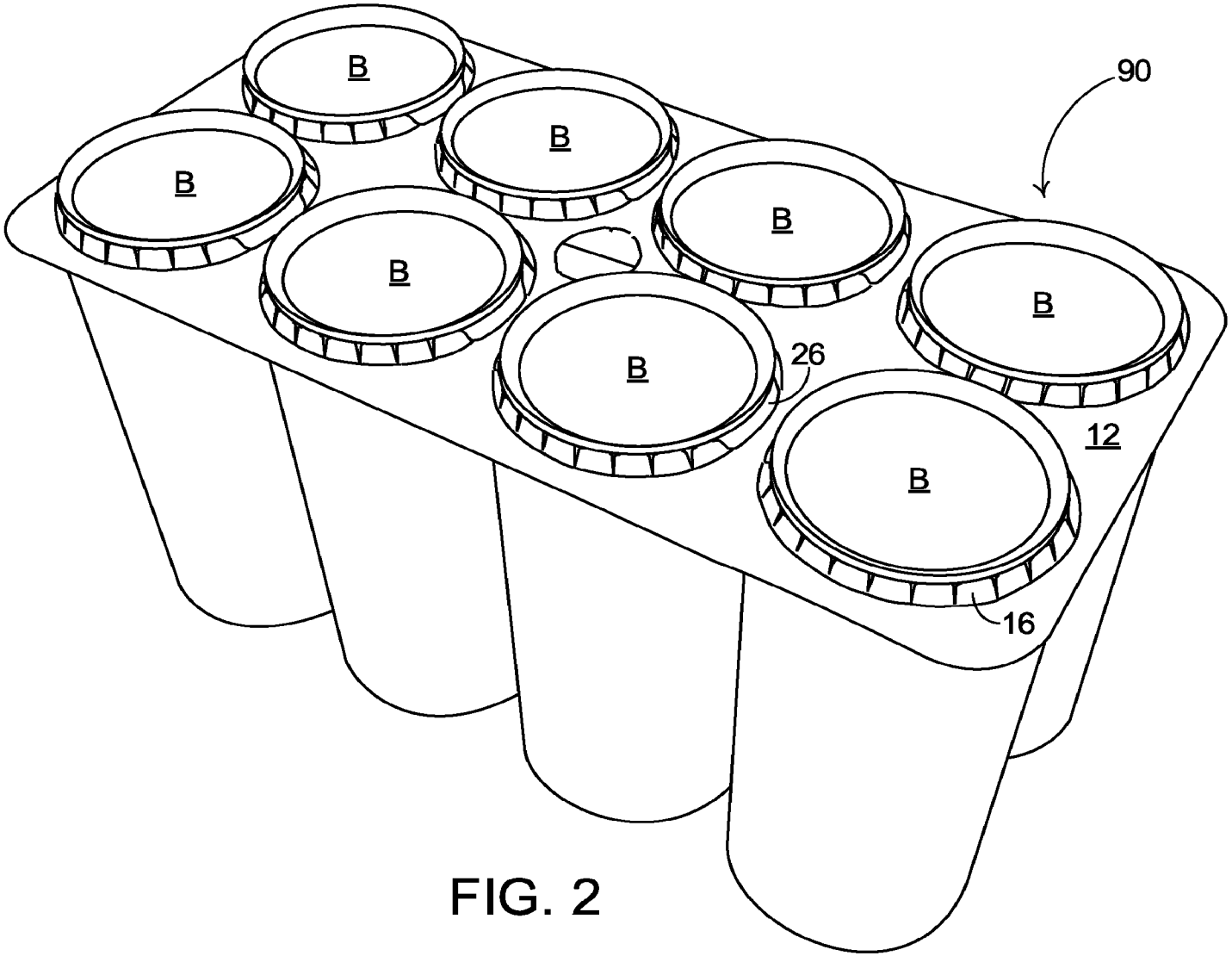
FIG. 2 is a perspective view from above of a carrier formed from the blank of FIG. 1.

Referring to FIG. 1, there is shown a plan view of a blank 10 which is capable of forming a carton or carrier 90, as shown in FIG. 2, for containing and carrying a group of primary products such as, but not limited to, bottles or cans, hereinafter referred to as articles B. The blank 10 forms a secondary package for packaging at least one primary product container or package. Alternative blanks 110, 210, 310, 410, 510, 610 are shown in FIGS. 3 to 6D.

Figure 7A:
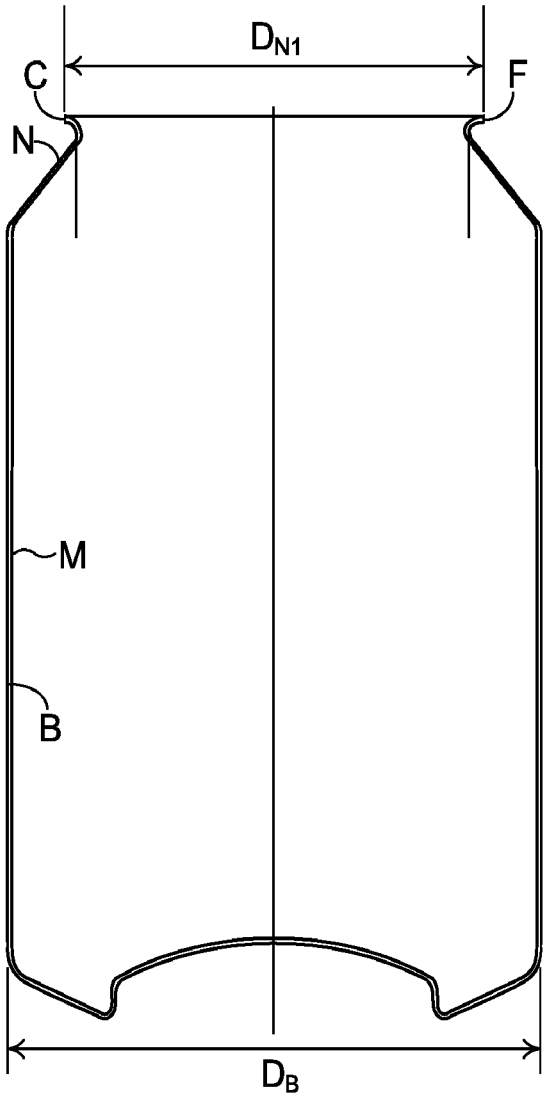
FIG. 7A is a cross sectional view of a first article.
Figure 7B:
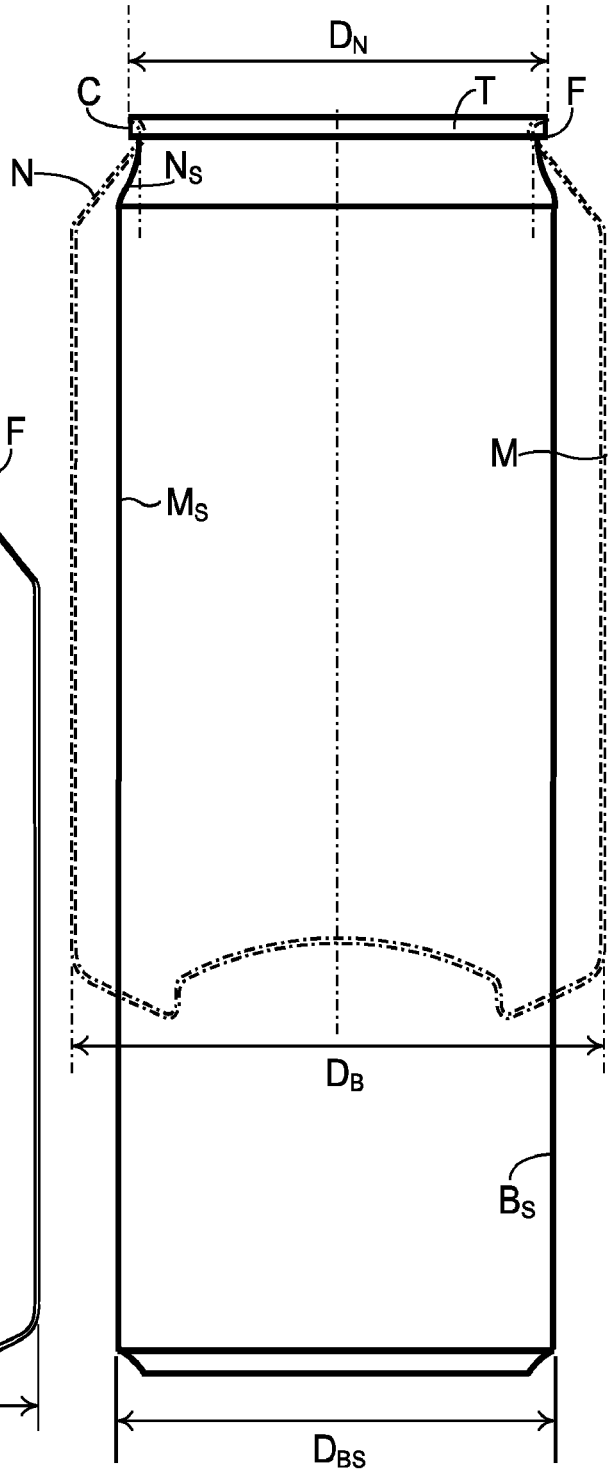
FIG. 7B is a side view of a second article showing a sectional view of the first article of FIG. 7A superimposed thereon.

In the embodiments of FIGS. 1, 2, 4, and 5, the beverage cans may be 330 ml cans of the sleek or slim design; that is to say the articles B are substantially of the same diameter over their entire height. An exemplary article $B_S$ is illustrated in FIG. 7B, the article $B_S$ has a maximum diameter or lateral dimension $D_{BS}$ (the diameter $D_{BS}$ may be about 2.25 inches or about 58 mm). The article $B_S$ comprises an upper portion or top closure T which has a diameter or lateral dimension $D_N$ (the diameter $D_N$ may be about 2.125 inches or 54.8 mm).

The neck $N_S$ may provide an outwardly projecting flange, that is to say it may comprise an undercut for engaging with the carrier. A top closure T may be attached to the side wall of the article $B_S$ to form a seam or "chime" C which provides the flange F. In some embodiments the variation in diameter between the top closure and the main body $M_S$ of the article B is less than 7 mm, may be less than 5 mm and optionally is less than 4 mm.

As used herein the terms "sleek" or "slim" refer to articles $B_S$ which have little or no variation in their lateral dimension between the top closure T which engages with the carrier 90 and the main body $M_S$ of the article $B_S$. The articles $B_S$ are substantially parallel sided or of substantially uniform diameter.

In the embodiments of FIGS. 3, 6A, 6B, 6C, and 6D, the beverage cans may be standard 330 ml cans. An exemplary article B is illustrated in FIG. 7A, the article B has a maximum diameter or lateral dimension DB (the diameter DB may be about 2.6 inches or about 66 mm). The article B comprises an upper portion or top closure which has a diameter or lateral dimension $D_{N1}$ (the diameter $D_{N1}$ may be about 2.125 inches or 54.8 mm). In some embodiments the variation in diameter between the top closure and the main body M of the article B is greater than 7 mm, may be 10 mm or more and optionally may be at least 12 mm.

In the embodiments detailed herein, the terms "carton" and "carrier" refer, for the non-limiting purpose of illustrating the various features of the invention, to a container for engaging and carrying articles, such as primary product containers. It is contemplated that the teachings of the invention can be applied to various product containers, which may or may not be tapered and/or cylindrical. Exemplary containers include bottles (for example metallic, glass or plastics bottles), cans (for example aluminum cans), tins, pouches, packets and the like.

The blanks 10, 110, 210, 310, 410, 510, 610 are formed from a sheet of suitable substrate. It is to be understood that, as used herein, the term "suitable substrate" includes all manner of foldable sheet material such as paperboard, corrugated board, cardboard, plastic, combinations thereof, and the like. It should be recognized that one or other numbers of blanks may be employed, where suitable, for example, to provide the carrier structure described in more detail below.

The packaging structures or cartons described herein may be formed from a sheet material such as paperboard, which may be made of or coated with materials to increase its strength. An example of such a sheet material is tear-resistant NATRALOCK® paperboard made by WestRock Company. It should be noted that the tear resistant materials may be provided by more than one layer, to help improve the tear-resistance of the package. Typically, one surface of the sheet material may have different characteristics to the other surface. For example, the surface of the sheet material that faces outwardly from a finished package may be particularly smooth and may have a coating such as a clay coating or other surface treatment to provide good printability. The surface of the sheet material that faces inwardly may, on the other hand, be provided with a coating, a layer, a treatment or be otherwise prepared to provide properties such as one or more of tear-resistance, good glue-ability, heat sealability, or other desired functional properties.

In the illustrated embodiments, the blank 10, 110, 210, 310, 410, 510, 610 are configured to form a carton or carrier 90; 290 for packaging an exemplary arrangement of exemplary articles B. In the illustrated embodiments the arrangement is a 4×2 matrix or array; two rows of four articles are provided, and the articles B are beverage cans. Alternatively, the blanks 10, 110, 210, 310, 410, 510, 610 can be configured to form a carrier for packaging other types, number and size of articles and/or for packaging articles in a different arrangement or configuration.

Referring to FIG. 1 there is shown a blank 10 which comprises a main panel 12 for forming a top wall or engaging panel of a carrier 90 (see FIG. 2).

The main panel 12 comprises opposed ends defining a longitudinal direction y therebetween. The main panel 12 comprises opposed sides defining a lateral or transverse direction x therebetween.

The blank 10 may be formed from a material having a grain or machine direction GR, the grain direction extends transversely of the blank 10, in a direction substantially parallel with the lateral direction x, as indicated in FIG. 1. When the material is paper or paperboard, fibers (such as cellulose fibers) have a tendency to be aligned during to the manufacturing process, this alignment defines the grain direction. The material is anisotropic, physical properties of the material are directionally dependent. For example, but not limited to, tear strength, fold endurance and stiffness are greater or higher across the grain direction (in the illustrated embodiment in the longitudinal direction y), tensile strength is greater along the grain or machine direction GR (in the illustrated embodiment in the transverse direction x). In alternative implementations, the grain direction GR may extend in a direction substantially parallel with the longitudinal direction (y-direction in FIG. 1) of the blank 10.

The main panel 12 includes at least one article retention structure RT1, RT2. In the embodiment of FIGS. 1 and 2 the main panel 12 comprises a plurality of article retention structures RT1, RT2 specifically eight article retention structures RT1, RT2 arranged in 4×2 matrix or array. Each of the article retention structures RT1, RT2 comprises an aperture A1, A2, A3, A4, A5, A6, A7, A8.

The blank 10 comprises four first article retention structures RT1. The first article retention structures RT1 are located adjacent to ends of the main panel 12. The blank 10 comprises four second article retention structures RT2. The second article retention structures RT2 are located between a first pair of first article retention structures RT1 disposed proximate a first end of the main panel 12 and a second pair of first article retention structures RT1 disposed proximate a second end of the main panel 12. The second article retention structures RT2 are also referred to herein as intermediate article retention structures RT2. The first article retention structures RT1 are also referred to herein as end article retention structures RT1.

The article retention structures RT1, RT2 are spaced apart from each other by a spacing d3. Adjacent article retention structures RT1, RT2 are disposed in close proximity to each other.

Figure 8:
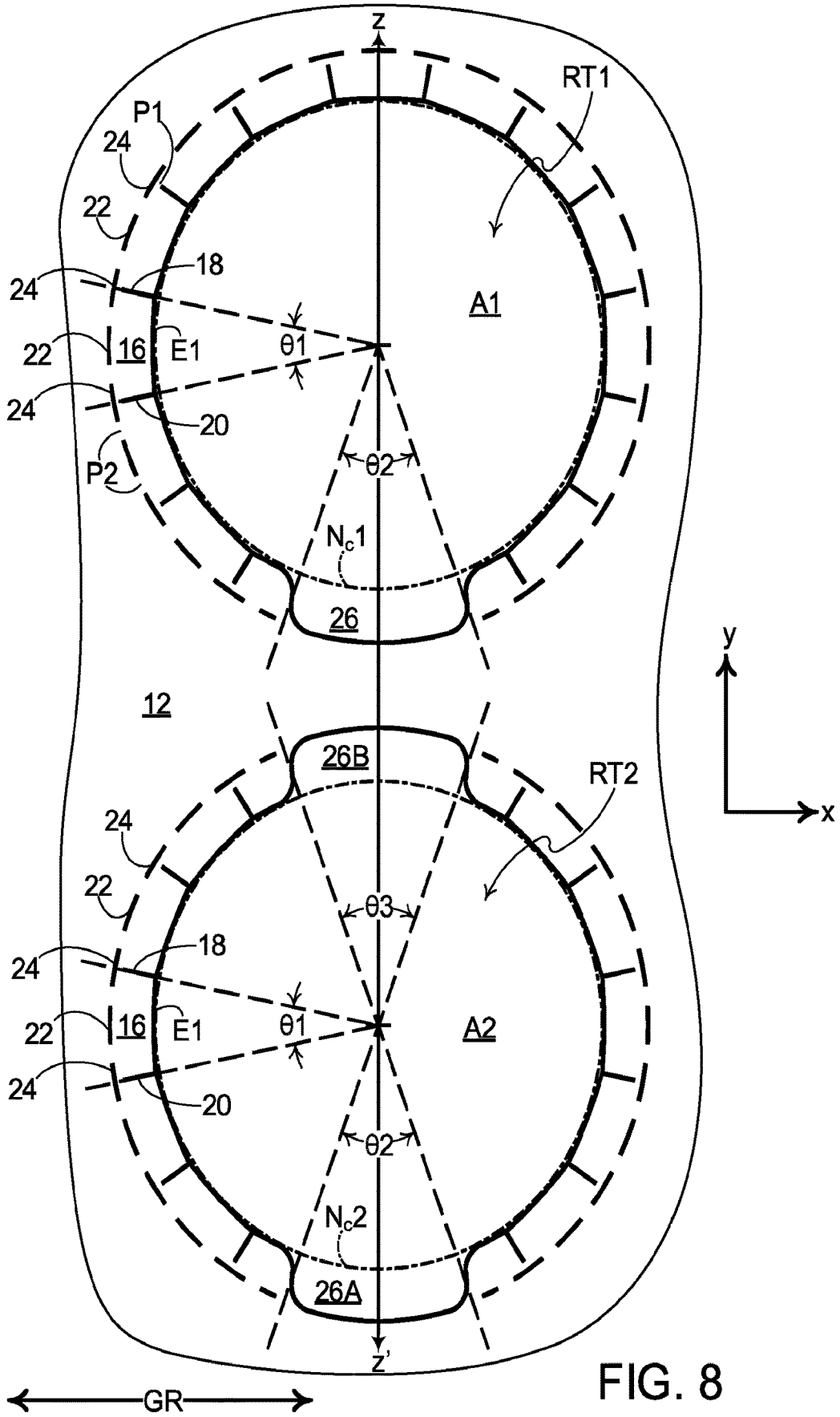
FIG. 8 is an enlarged plan view from above of a portion of the blank of FIG. 1.

Each of the first article retention structures RT1 is substantially similar in construction and will therefore be described in detail with reference to a first one of the first article retention structures RT1 located adjacent to a first end of the blank 10 as shown in FIG. 8.

The first article retention structure RT1 comprises an article receiving opening defined in part by an aperture A1.

The first article retention structure RT1 comprises a plurality of teeth 16, 14 disposed about the aperture A1. The plurality of teeth 16, 14, or at least free edges thereof, may define or approximate a notional circle $N_c$1. The notional circle $N_c$1 has a diameter d1.

The aperture A1 has a width dimension d1. The article receiving opening has width or diameter d2. The diameter d2 of the article receiving opening is greater than the diameter d1 of notional circle $N_c$1 or aperture A1.

The plurality of teeth 16, 14 are hinged to the main panel 12 by a fold line. The fold line may be defined by a plurality of cut lines 22, 24. The plurality of cut lines 22, 24 may define or approximate a circle.

The first article retention structure RT1 comprises a plurality of first or full teeth 16 disposed about the aperture A1. Each of the plurality of first teeth 16 comprises an engaging edge E1 opposing a hinged edge. The engaging edges E1 are defined by a linear portion of a cut line defining the aperture A1. Each engaging edge E1 defines a part of a hexadecagon. The illustrated embodiment comprises thirteen first teeth 16 together defining a substantial portion of a hexadecagon. Each tooth 16 comprises a pair of side edges, the side edges are defined by cut lines 18, 20 extending radially outward from respective vertices of the hexadecagon. That is to say from a respective vertex between a pair of adjacent linear portions of the cut line defining the aperture A1. The cut lines 18, 20 are divergently arranged with respect to each other and define an angle θ1 therebetween. Optionally, the angle θ1 may be about 22.5°.

The first article retention structure RT1 comprises a plurality of first circumferential cut lines 24. Each of the plurality of first circumferential cut lines 24 is aligned with one of the radial cut lines 18, 20 such that said one of the radial cut lines 18, 20 or a notional extension thereof bisects a respective one of the plurality of first circumferential cut lines 24.

Each of the plurality of first circumferential cut lines 24 is spaced apart from said one of the radial cut lines 18, 20 bisecting it so as to define a connecting nick or bridge portion P1 between a pair of adjacently disposed teeth 16, 14.

Each of the plurality of first circumferential cut lines 24 may be linear in shape.

The first article retention structure RT1 comprises a plurality of second circumferential cut lines 22. Each of the plurality of second circumferential cut lines 22 is disposed between a pair of the plurality of first circumferential cut lines 24 and is spaced apart therefrom so as to define a pair of connecting nick or bridge portions P2 between each tooth 16, 14 and the main panel 12. The pair of connecting nick or bridge portions P2 provide a hinged or foldable connection between each tooth 16, 14 and the main panel 12.

Each of the plurality of second circumferential cut lines 22 may be linear in shape.

In alternative embodiments, each of the plurality of first circumferential cut lines 24 may be arcuate or curved. The first circumferential cut lines 24 may comprise a radius of curvature which is equal to half the diameter d2 of the article receiving openings. The first circumferential cut lines 24 may comprise a radius of curvature which is greater than half the diameter d1 of the apertures A1, A2, A3, A4, A5, A6, A7, A8.

In alternative embodiments each of the plurality of second circumferential cut lines 22 may be arcuate or curved. The second circumferential cut lines 22 may comprise a radius of curvature which is equal to half the diameter d2 of the article receiving openings. The second circumferential cut lines 22 may comprise a radius of curvature which is greater than half the diameter d1 of the aperture A1, A2, A3, A4, A5, A6, A7, A8.

The first and second circumferential cut lines 22, 24 when linear may be considered to define portions of a circle of infinite radius.

In the illustrated embodiment, the radius of curvature of each of the plurality of second circumferential cut lines 22 is equal to the radius of curvature of each of the plurality of first circumferential cut lines 24; however, in other embodiments, they may be different.

In either embodiment, whether each of the first 24 and second 22 circumferential cut lines is linear or arcuate, each of the first circumferential cut lines 24 is optionally equal in length to each of the second circumferential cut lines 22. Further, the distance between each adjacent cut line 22 and cut line 24 may be equal, such that each non-cut portion between adjacent cut lines 22/24 may be equal in length.

The plurality of teeth 16, 14 is interrupted by a recess or cutaway 26. The recess 26 lies upon a notional line z-z'. Notional line z-z' extends radially from the center of the aperture A1 and passes through the center of the recess 26. The notional line z-z' extends across the grain GR of the blank 10. The notional line z-z' is oriented substantially perpendicularly with respect to the grain direction GR. In alternative implementations, the notional line z-z' may be oriented substantially parallel to the grain direction GR.

The recess 26 is dimensioned so as to occupy an arc defined by a first minor sector. The first minor sector is defined in part by a first notional line extending radially from the center of the notional circle $N_c$1 and passing through a side edge of a first partial tooth 14 and in part by a second notional line extending radially from the center of the notional circle $N_c$1 and passing through a side edge of a second partial tooth 14. The first and second notional lines define a second angle θ2 therebetween. The second angle θ2 may be in the range 35° to 50°, and may be around 45°.

The first and second notional lines define a first major sector, the first major sector defines a second arc the plurality of teeth 16, 14 occupy the second arc. That is to say the plurality of teeth 16, 14 are disposed about the second arc, in a perimeter region of the first aperture A1.

Each of the second article retention structures RT2 is substantially similar in construction and will therefore be described in detail with reference to a first one of the second article retention structures RT2 located adjacent to the first one of the first article retention structures RT1 as shown in FIG. 8.

The second article retention structure RT2 comprises an article receiving opening defined in part by a second aperture A2.

The second article retention structure RT2 comprises a plurality of teeth 16, 14 disposed about the second aperture A2. The plurality of teeth 16, 14, or at least free edges thereof, may define or approximate a second notional circle $N_c$2.

The plurality of teeth 16, 14 are hinged to the main panel 12 by a fold line. The fold line may be defined by a plurality of cut lines 22, 24. The plurality of cut lines 22, 24 may define or approximate a circle.

The second aperture A2 comprises a plurality of first or full teeth 16 disposed about the second aperture A2. Each of the plurality of first teeth 16 comprises an engaging edge E1 opposing a hinged edge. The engaging edges E1 are defined by a linear portion of a cut line defining the second aperture A2. Each engaging edge E1 defines a part or side of a hexadecagon. The illustrated embodiment comprises ten first teeth 16 together defining a substantial portion of a hexadecagon. Each tooth 16 comprises a pair of side edges, the side edges are defined by cut lines 18, 20 extending radially outward from respective vertices of the hexadecagon. That is to say from a respective vertex between a pair of adjacent linear portions of the cut line defining the second aperture A2. The cut lines 18, 20 are divergently arranged with respect to each other and define an angle θ1 therebetween, the angle θ1 may be about 22.5°.

The second article retention structure RT2 comprises a plurality of first circumferential cut lines 24. Each of the plurality of first circumferential cut lines 24 is aligned with one of the radial cut lines 18, 20 such that said one of the radial cut lines 18, 20, or a notional extension thereof, bisects a respective one of the plurality of first circumferential cut lines 24.

Each of the plurality of first circumferential cut lines 24 is spaced apart from said one of the radial cut lines 18, 20 bisecting it so as to define a connecting nick or bridge portion between a pair of adjacently disposed teeth 16, 14. The connecting nick or bridge portion is disposed proximate a base of the teeth 16.

Each of the plurality of first circumferential cut lines 24 may be linear in shape.

The second article retention structure RT2 comprises a plurality of second circumferential cut lines 22. Each of the plurality of second circumferential cut lines 22 is disposed between a pair of the plurality of first circumferential cut lines 24 and is spaced apart therefrom so as to define a pair of connecting nick or bridge portions between each tooth 16, 14 and the main panel 12.

The pair of connecting nick or bridge portions provide a hinged or foldable connection between each tooth 16, 14 and the main panel 12.

Each of the plurality of second circumferential cut lines 22 may be linear in shape.

The plurality of teeth 16, 14 is interrupted by a first recess or cutaway 26A and by a second recess or cutaway 28B. The first and second recesses 26A, 26B each lie upon a notional line z-z'. Notional line z-z' extends radially from the center of the second aperture A2 and passes through the center of each of the first and second recesses 26A, 26B. The notional line z-z' extends across the grain GR of the blank 10. The notional line z-z' is oriented substantially perpendicularly with respect to the grain direction GR. In alternative implementations, the notional line z-z' may be oriented substantially parallel with the grain direction GR.

The first recess 26A is dimensioned so as to occupy an arc defined by a first minor sector. The first minor sector is defined in part by a first notional line extending radially from the center of the notional circle $N_c$1 and passing through a side edge of a first partial tooth 14 and in part by a second notional line extending radially from the center of the notional circle $N_c$1 and passing through a side edge of a second partial tooth 14. The first and second notional lines define a second angle θ2 therebetween. The second angle 82 may be in the range 35° to 50°, and may be around 45°.

The second recess 26B is dimensioned so as to occupy a second arc defined by a second minor sector. The second minor sector is defined in part by a third notional line extending radially from the center of the notional circle $N_c$1 and passing through a side edge of a third partial tooth 14 and in part by a fourth notional line extending radially from the center of the notional circle $N_c$1 and passing through a side edge of a fourth partial tooth 14. The third and fourth notional lines define a third angle θ3 therebetween. The third angle θ3 may be in the range 35° to 50°, and may be around 45°.

The first, second, third and fourth notional lines define first and second major sectors, the first and second major sectors define a third arc and a fourth arc respectively. The plurality of teeth 16, 14 occupy the third and fourth arcs. That is to say the plurality of teeth 16, 14 are disposed about the third and fourth arcs, in a perimeter region of the second aperture A2.

The first and second recesses 26A, 26B are diametrically opposed to each other.

The center of the first and second recesses 26A, 26B of the second article retention structure RT2 are collinear with the center of the recess 26 of the first article retention structure RT1.

The second recess 26B of the second article retention structure RT2 is disposed proximate to the recess 26 of the first article retention structure RT1 and is oriented in opposition thereto.

The grain of the material forming the blank 10 is arranged to be tangential to the center of the first and second recesses 26A, 26B of the second article retention structure RT2. The grain of the material forming the blank 10 is arranged to be tangential to the center of the recess 26 of the first article retention structure RT1.

In this way in order for a tear to propagate between the first aperture A1 and the third aperture A3 the tear must propagate across the grain GR of the blank 10. In this way the blank 10 is arranged to provide maximum resistance to tear propagation between the first and third apertures A1, A3.

In alternative implementations, the grain of the material forming the blank 10 may be arranged to be substantially parallel to the line connecting the collinear center of the first and second recesses 26A, 26B of the second article retention structure RT2 and center of the recess 26 of the first article retention structure RT1. In this alternative implementation, in order for a tear to propagate between the first aperture A1 and the second aperture A2, the tear must propagate across the grain GR of the blank 10, so that the blank 10 is arranged to provide maximum resistance to tear propagation between the first and third apertures A1, A2.

Removal of the teeth 16, by providing recesses 26, 26A, 26B at locations where two adjacent apertures A1, A2 are disposed in close proximity, for example when packaging articles B of the sleek or slim design, has been found to reduce the likelihood of tear propagation. This beneficial advantage may be a result of removal of the radial cut lines 18, 20 in regions of the blank 10 where the apertures A1, A2 are in closest proximity.

In one example the spacing d3 between adjacent article retention structures RT1, RT2 may be around 0.186 inches (4.7 mm). The diameter d1 of notional circle $N_c$1 or of the apertures A1, A2, A3, A4, A5, A6, A7, A8 may be around 1.771 inches (44.9 mm). The diameter d2 of the article receiving openings may be around 2.098 inches (53.2 mm). The teeth 16 may have a radial dimension or height (measured between the free or engaging edge E1 and the hinged connection to the main panel 12) of around 0.1625 inches (4.15 mm). The radial dimension of the teeth 16 is given by:

$$\tfrac{1}{2}(d2-d1).$$

The article receiving openings are disposed in close proximity to each other.

The diameter d2 of the article receiving openings is around eleven times greater than the spacing between them.

The spacing d3 between article receiving openings may be less than half the diameter d2 of the article receiving openings. It may be less than a quarter, or fifth, of the diameter d2 of the article receiving openings. In some embodiments the spacing d3 between article receiving openings may be less than an eighth, or tenth, of the diameter d2 of the article receiving openings.

The spacing d3 between article receiving openings may less than twice the radial dimension or height of the teeth 16. In some embodiments the spacing d3 between article receiving openings may less than 50% larger than the radial dimension or height of the teeth 16. In some embodiments the spacing d3 between article receiving openings may less than 20% greater than the radial dimension or height of the teeth 16.

The distance between the center of each of the apertures and the edge of each of the recesses 26, 26A, 26B, respectively, may be greater than or equal to half the diameter or lateral dimension $D_N$, $D_{N1}$ of the upper portion or top closure of the article.

The main panel 12 may optionally comprise a handle structure H. The handle structure H may comprise a handle opening. The handle opening is struck from the main panel 12 and is located in a region disposed centrally between a first pair of second article retention structures RT2 and a second pair of second article retention structures RT2. The handle opening may be defined in part by a pair of tabs 60, 62 hinged to the main panel 12 in opposition to each other by fold lines 61, 63 respectively.

In other embodiments further handle openings may be provided between a first pair of the first article retention structures RT1 and the first pair of second article retention structures RT2 and/or between second pair of second article retention structures RT2 and a second pair of the first article retention structures RT1.

The main panel 12 includes at least a paperboard substrate. The material of the paperboard substrate may be selected from any conventional paperboard, for example, ranging in weight upwardly from about 10 pt., preferably from about 16 pt. to about 28 pt. (0.028"/~0.7 mm). An example of such a substrate is a 28 point (pt.) SBS board (solid bleached sulfate paperboard coated on one side, trade name PrintKote®) or CNK® board (Coated Natural Kraft®—an unbleached kraft paperboard having a clay coating on one side, trade name CarrierKote™) manufactured by WestRock® Company. The paperboard substrate may be a bleached or unbleached board. The board may be coated on at least one side, optionally the side opposite the lamination, with a conventional coating selected for compatibility with the printing method and board composition.

The main panel 12 may include a tear resistant layer laminated to the paperboard layer. It optionally includes an adhesive layer between the paperboard substrate and the tear resistant layer. The tear resistant layer may be disposed over the uncoated side of the paperboard substrate and may be formed of polymeric material and secured to the substrate. The tear resistant layer imparts toughness to the laminate structure. Suitable tear resistant materials may include, but not be limited to, tear resistant laminated sheet material, e.g., NATRALOCK®, which may include a layer of an n-axially oriented film, e.g. MYLAR®, which is a bi-axially oriented polyester, oriented nylon, cross-laminated polyolefin or high density polyolefin. The orientation and cross-laminated structure of these materials contribute to the tear resistant characteristic. Also, tear resistance may be attributed to the chemical nature of the tear resistant material such as extruded metallocene-catalyzed polyethylene (mPE).

Alternatively, the tear resistant layer may be a layer of linear low-density polyethylene (LLDPE). In embodiments where linear low-density polyethylene (LLDPE) or mPE is used, it is not necessary to incorporate an adhesive layer. Other suitable materials having a high level of tear resistance may also be used.

The adhesive layer may be formed of polyolefin material such as a low-density polyethylene (LDPE). The adhesive layer may be placed between the substrate and the tear resistant layer to secure the tear resistant layer to the substrate.

Turning to the construction of the carrier 90 from the blank 10, the blank 10 may be applied to a group of articles B. The blank 10 is lowered with respect to the group of articles B. Each of the article retention structures RT1, RT2 of the blank 10 is aligned with a respective article B in the group. Portions of the articles B pass through the main panel 12. The toothed regions of the main panel 12 about each of the article retention structures RT1, RT2 may be folded out of the plane of the main panel 12.

The engaging edges E1 of the teeth 16, 14 engage beneath a projection. The projection may be located about the neck or chime of the article B (which may provide a flange) of an article B. When the article B is can the projection may be provided by a canner's end seam. In other embodiments it may be provided by a ridge or undercut shaping of the article B or by an end closure of the article B for example but not limited to a crown cork or closure. In this way, the engaging edges E1 grip or hold the article B and prevent or inhibit the article B from unintentionally separating from the main panel 12. The assembled carrier 90 is shown in FIG. 2.

Another optional feature of the carrier 90 is that the main panel 12 is defined by a perimeter to which no other part of the carrier 90 is connected. That is to say, the carrier 90 is free of connection to other panels for example, but not limited to, side or end wall panels which extend about the sides of the article group. The perimeter of the main panel 12 is therefore defined in its entirety by free, cut or unhinged edges.

Referring now to FIGS. 3 to 6D, there are shown additional embodiments of the present disclosure. In the second, third, fourth, fifth, sixth, seventh, eighth and ninth illustrated embodiment like numerals have, where possible, been used to denote like parts, albeit with the addition of the prefix "100", "200", "300", "400", "500", "600" to indicate that these features belong to the second, third, fourth, fifth, sixth, and seventh embodiments respectively. The additional embodiments share many common features with the first embodiment and therefore only the differences from the embodiment illustrated in FIGS. 1, 2, and 8 will be described in detail.

Figure 3:
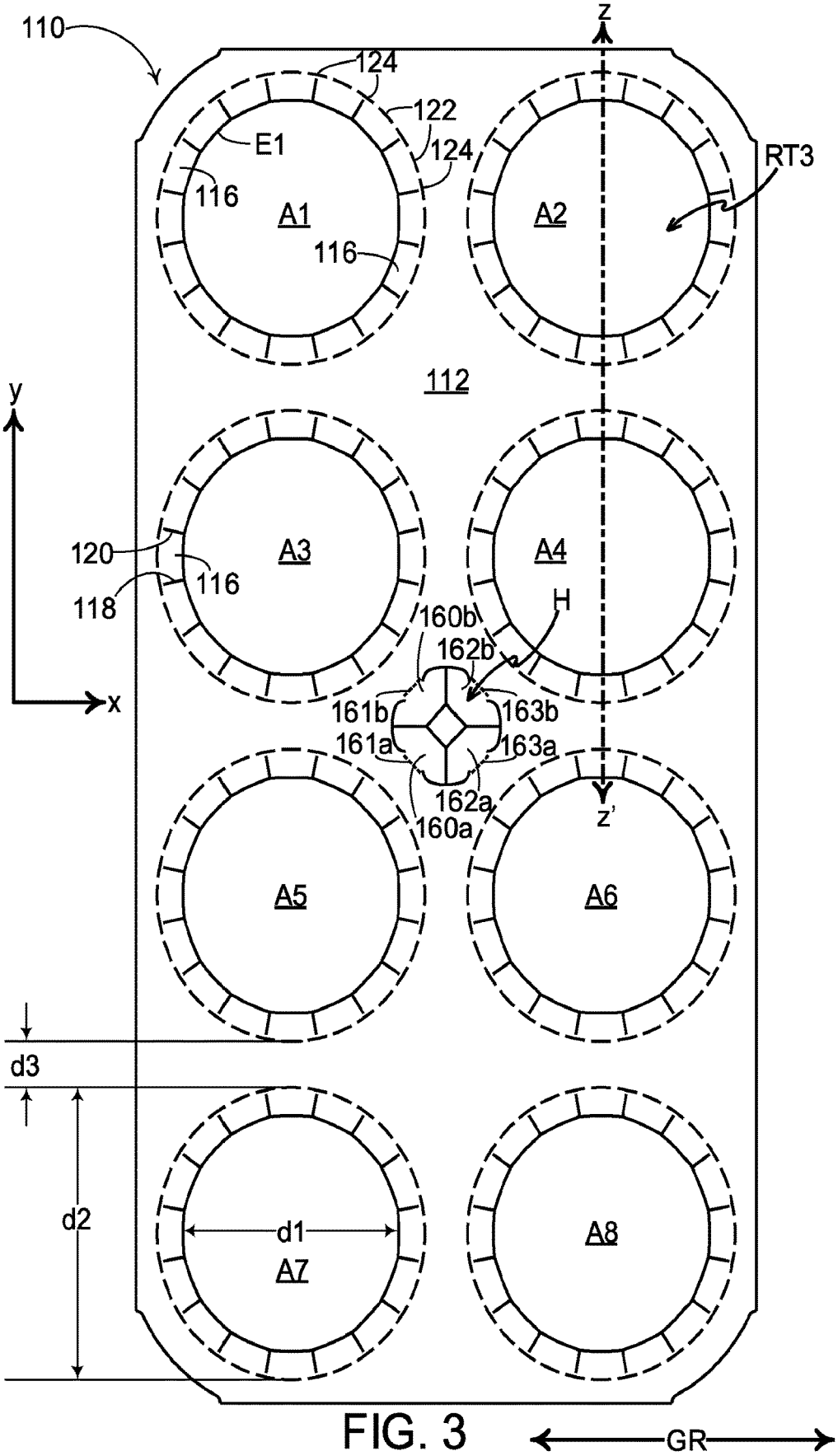
FIG. 3 is a plan view from above of a blank for forming a carrier according to a second embodiment.

FIG. 3 illustrates a second embodiment and shows a blank 110 of forming an article carrier (not shown). The blank 110 comprises a main panel 112 for forming a top wall or engaging panel of the carrier (not shown).

The main panel 112 of the blank 110 includes at least one article retention structure RT3. The main panel 112 comprises a plurality of article retention structures RT3 specifically eight article retention structures RT3 arranged in 4×2 matrix or array. Each of the article retention structures RT3 comprise an aperture A1, A2, A3, A4, A5, A6, A7, A8.

The recesses 26, 26A, 26B of the article retention structures RT1, RT2 of the embodiment of FIG. 1 have been omitted. The article retention structures RT3 of the blank 110 shown in FIG. 3 may be adapted to package an article B in which the main body of the articles B is wider than the articles B package by the embodiment of FIG. 1. FIG. 7A shows an example of such an article B. Due to the wider nature of the main body of the articles B the article retention structures RT3, and hence the apertures A1, A2, A3, A4, A5, A6, A7, A8, may be spaced further apart in the embodiment of FIG. 3 than the article retention structures RT1, RT2 of the embodiment of FIG. 1.

In one example the spacing d3 between adjacent article retention structures RT3 may be around 0.355 inches (9 mm). The diameter d1 of the notional circle or of the apertures A1, A2, A3, A4, A5, A6, A7, A8 may be around 1.806 inches (45.9 mm). The diameter d2 of the article receiving openings may be around 2.245 inches (57 mm). The teeth 116 may have a radial dimension or height (measured between the free or engaging edge E1 and the hinged connection to the main panel 112) of around 0.2195 inches (5.6 mm).

The article receiving openings are disposed in close proximity to each other.

The diameter d2 of the article receiving openings is around six times greater than the spacing between them.

The spacing d3 between article receiving openings may be less than half the diameter d2 of the article receiving openings. It may be less than a quarter or fifth of the diameter d2 of the article receiving openings.

The spacing d3 between article receiving openings may less than twice the radial dimension or height of the teeth 116.

The article retention structures RT3 comprise an article receiving opening defined in part by an aperture A1, A2, A3, A4, A5, A6, A7, A8.

The article retention structures RT3 comprise a plurality of teeth 116 disposed about a respective one of the apertures A1, A2, A3, A4, A5, A6, A7, A8. The plurality of teeth 116, or at least free edges thereof, may define or approximate a notional circle.

The plurality of teeth 116 are hinged to the main panel 112 by a fold line. The fold line may be defined by a plurality of cut lines 122, 124. The plurality of cut lines 122, 124 may define or approximate a circle.

The article retention structures RT3 comprise a plurality of first or full teeth 116 disposed about a respective aperture A1, A2, A3, A4, A5, A6, A7, A8. Each of the plurality of first teeth 116 comprises an engaging edge E1 opposing a hinged edge. The engaging edges E1 are defined by a linear portion of a cut line defining the respective aperture A1, A2, A3, A4, A5, A6, A7, A8. Each engaging edge E1 defines a part of a hexadecagon. The illustrated embodiment comprises sixteen first teeth 116 together defining the hexadecagon. Each tooth 116 comprises a pair of side edges, the side edges are defined by cut lines 118, 120 extending radially outward from respective vertices of the hexadecagon. That is to say from a respective vertex between a pair of adjacent linear portions of the cut line defining the respective aperture A1, A2, A3, A4, A5, A6, A7, A8. The cut lines 118, 120 are divergently arranged with respect to each other and define an angle 81 therebetween, the angle 81 may be about 22.5°.

The article retention structures RT3 comprise a plurality of first circumferential cut lines 124. Each of the plurality of first circumferential cut lines 124 is aligned with one of the radial cut lines 118, 120 such that said one of the radial cut lines 118, 120, or a notional extension thereof, bisects a respective one of the plurality of first circumferential cut lines 124.

Each of the plurality of first circumferential cut lines 124 is spaced apart from said one of the radial cut lines 118, 120 bisecting it so as to define a connecting nick or bridge portion between a pair of adjacently disposed teeth 116.

Each of the plurality of first circumferential cut lines 124 may be linear in shape.

The article retention structures RT3 comprise a plurality of second circumferential cut lines 122. Each of the plurality of second circumferential cut lines 122 is disposed between a pair of the plurality of first circumferential cut lines 124 and is spaced apart therefrom so as to define a pair of connecting nick or bridge portions between each tooth 116 and the main panel 112. The pair of connecting nick or bridge portions provide a hinged or foldable connection between each tooth 116 and the main panel 112.

Each of the plurality of second circumferential cut lines 122 may be linear in shape.

The main panel 112 may optionally comprise a handle structure H. The handle structure H may comprise a handle opening. The handle opening is struck from the main panel 112 and is located in a region disposed centrally between a first pair of second article retention structures RT2 and a second pair of second article retention structures RT2. The handle opening may be defined in part by two pairs of tabs 160*a*, 160*b*; 162*a*, 162*b* hinged to the main panel 112 by fold lines 161 161*b*, 163*a*, 163*b* respectively.

Figure 4:
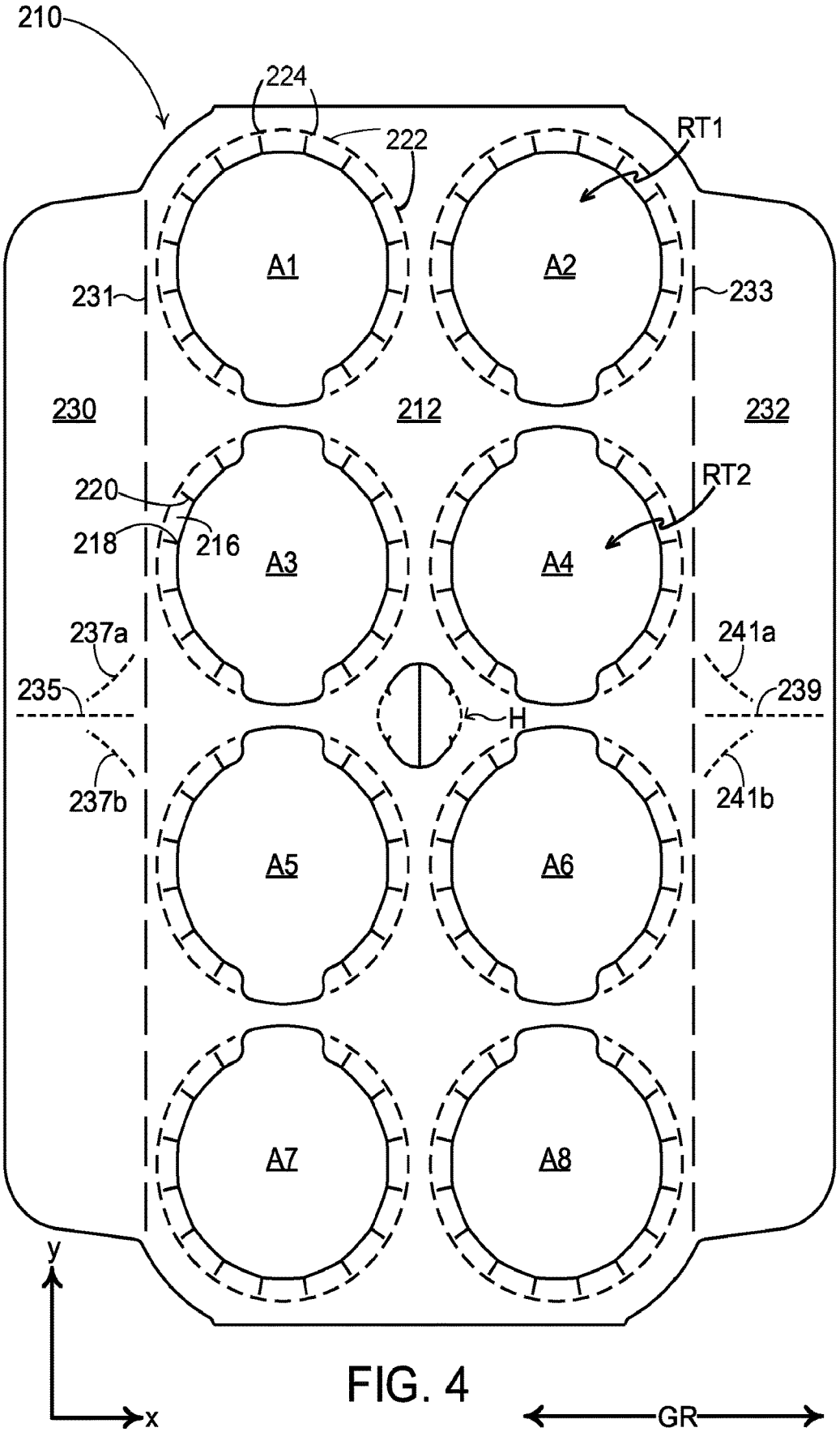
FIG. 4 is a plan view from above of a blank for forming a carrier according to a third embodiment.
Figure 5:
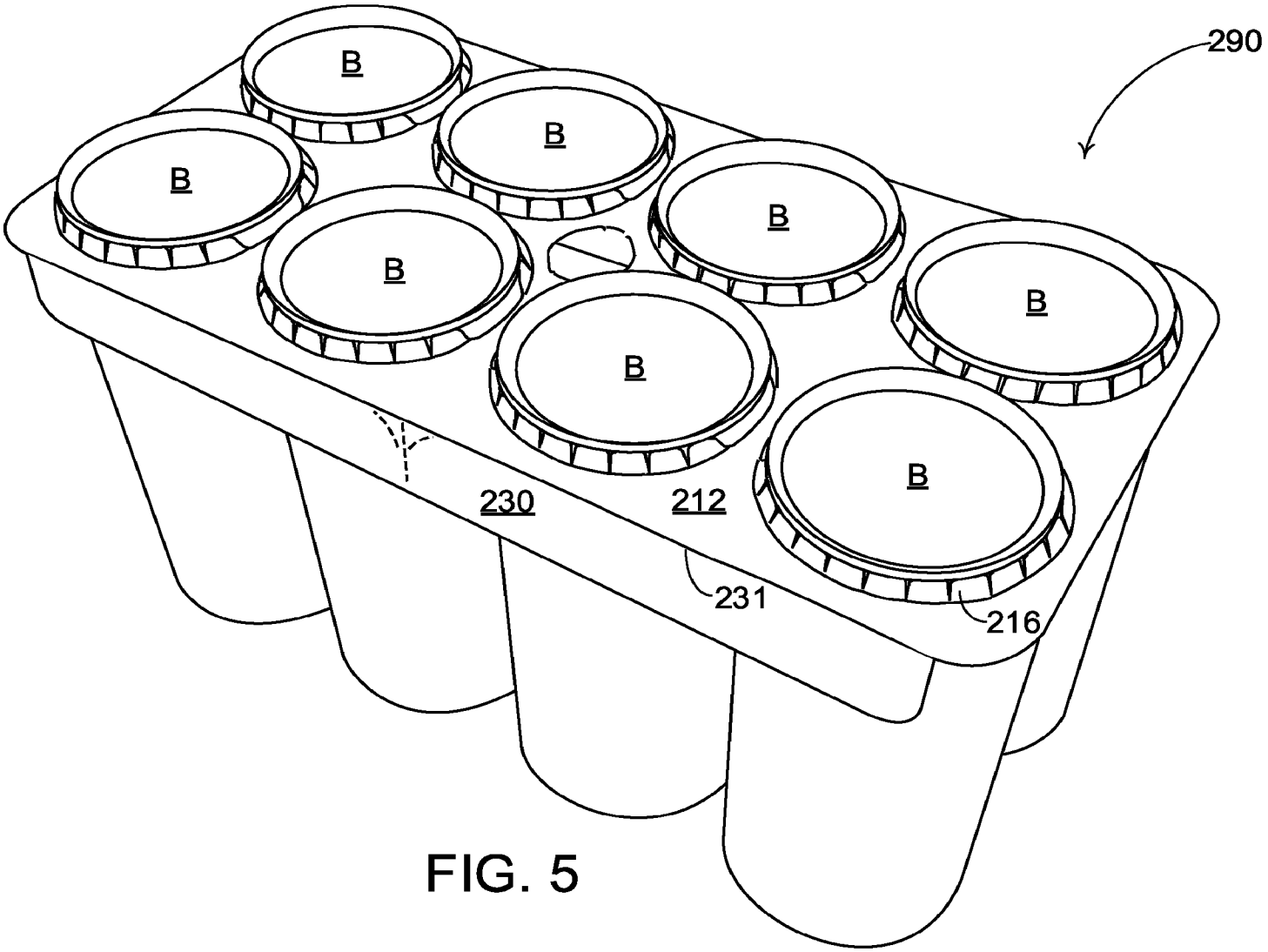
FIG. 5 is a perspective view from above of a carrier formed from the blank of FIG. 4.

FIGS. 4 and 5 illustrate a third embodiment and show a blank 210 forming an article carrier 290. The blank 210 comprises a main panel 212 for forming a top wall or engaging panel of the carrier 290.

The main panel 212 comprises a plurality of article retention structures RT1, RT2 specifically eight article retention structures RT1, RT2 arranged in 4×2 matrix or array. The article retention structures RT1, RT2 are substantially similar in construction to those of the embodiment shown in FIG. 1 and will not be described in further detail.

The blank 210 comprises a first side or end panel 230 (also referred to herein as a first securing panel) hingedly connected to the main panel by a hinged connection in the form of a fold line 231.

The blank 210 comprises a second side or end panel 232 (also referred to herein as a first securing panel) hingedly connected to the main panel by a hinged connection in the form of a fold line 233. The second side or end panel 232 is hingedly connected to a side or end of the main panel 212 which opposes the side or end of the main panel 212 to which the first side or end panel 230 is hinged.

Each of the first and second side or end panels 230, 232 form a display or advertising panel, the panels 230, 232 are secured with suitable adhesive to one or more of the adjacently disposed articles B.

A fugitive glue may be employed to secure the panels 230, 232 directly to the articles B. An example of a specific glue is Swift 7044 manufactured by HB Fuller. Use of a fugitive glue is optional, an advantage of a fugitive glue is its tendency to remain attached to the carrier 290 when the articles B are disengaged from the carrier 290 (this may be more desirable than having the glue remain attached to the articles B). In alternative embodiments other adhesives may be employed such as, but not limited to, hot-melt glue.

Each of the panels 230, 232 may comprise a folding structure for forming part of a handle structure along with a handle opening H. The folding structure may comprise one or more fold lines 235, 237*a*, 237*b*, 239, 241*a*, 241*b*. A first fold line 235, 239 is provided in a respective one of the panels 230, 232. The first fold lines 235, 239 are oriented substantially perpendicular to the fold line 231, 233 hinging the respective one of the panels 230, 232 to the main panel 212. Additionally or alternatively the folding structure may comprise a pair of divergent fold lines 237*a*, 237*b*, 241*a*, 241*b*. Each of the pair of divergent fold lines 237*a*, 237*b*, 241*a*, 241*b* may be disposed on opposing side of the first fold line 235, 239.

The folding structure is provided in a region of the first or second securing panels 230, 232 proximate a gap or void between a pair of adjacent apertures A3/A5, A4/A6. The handle opening H is provided in a region of the blank 210 disposed between the pairs of apertures A3/A5, A4/A6.

In this way the folding structures and handle opening a collinearly aligned. The folding structures define a foldable or deformable region of in a respective one of the first and second securing panels 230, 232. A user may engage the carrier 290 by grasping the carrier 290, either by grasping both folding structures or by grasping one of the folding structures and the handle opening.

Figure 6A:
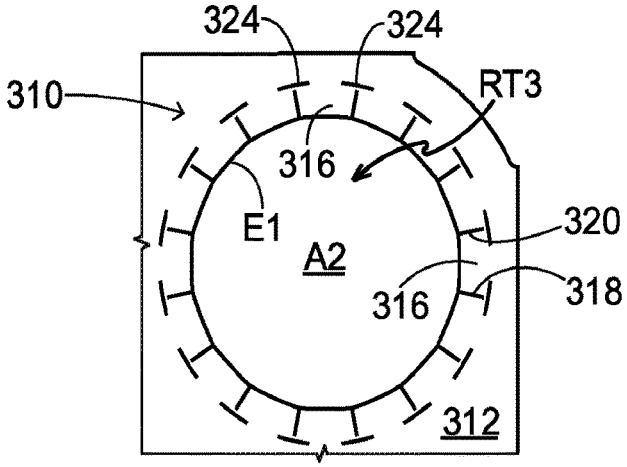
FIGS. 6A to 6D illustrate plan views from above of blanks according to further embodiments of the disclosure.

FIG. 6A illustrates a fourth embodiment and shows a portion of a blank 310 for forming an article carrier (not shown).

FIG. 6A shows an article retention structure RT3 comprising an aperture A2 and a plurality of teeth 316 disposed in a main panel 312 of the blank 310 about the aperture A2. In the embodiment of FIG. 6A, the plurality of second circumferential cut lines 22; 122; 222 of the previous embodiments have been omitted. Each tooth 316 is hingedly connected to the main panel 312 by a single bridging portion disposed between a pair of adjacently disposed ones of a plurality of first circumferential cut lines 324.

Figure 6B:
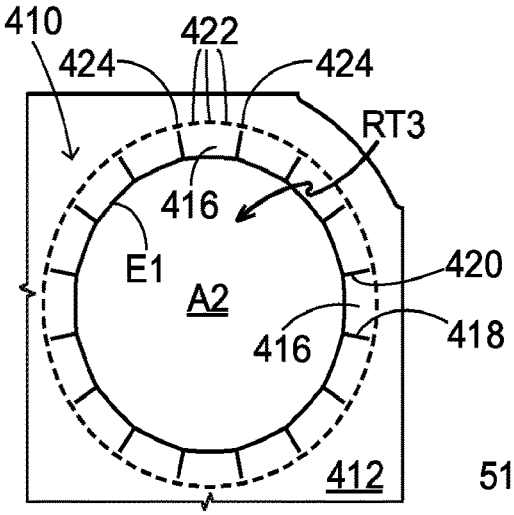

FIG. 6B illustrates a fifth embodiment and shows a portion of a blank 410 for forming an article carrier (not shown).

FIG. 6B shows an article retention structure RT3 comprising an aperture A2 and a plurality of teeth 416 disposed in a main panel 412 of the blank 410 about the aperture A2.

The article retention structure RT3 comprises a plurality of first circumferential cut lines 424. Each of the plurality of first circumferential cut lines 424 is aligned with a radial cut line 418, 420 wherein the radial cut lines 418, 420 define side edges of the teeth 416 such that the radial cut line 418, 420, or a notional extension thereof, bisects a respective one of the plurality of first circumferential cut lines 424.

In the embodiment of FIG. 6B article retention structure RT3 comprises a plurality of second circumferential cut lines 422. The article retention structure RT3 comprises three second circumferential cut lines 422 disposed between a pair of adjacently disposed ones of the plurality of first circumferential cut lines 424.

Each tooth 416 is hingedly connected to the main panel 412 by a plurality of bridging portions, specifically four bridging portions, located between a pair of adjacently disposed ones of the plurality of first circumferential cut lines 424.

Figure 6C:
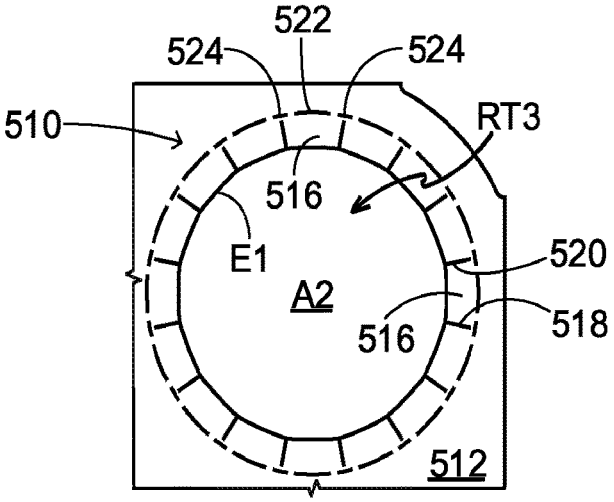

FIG. 6C illustrates a sixth embodiment and shows a portion of a blank 510 for forming an article carrier (not shown).

FIG. 6C shows an article retention structure RT3 comprising an aperture A2 and a plurality of teeth 516 disposed in a main panel 512 of the blank 510 about the aperture A2.

The article retention structure RT3 comprises a plurality of first circumferential cut lines 524. Each of the plurality of first circumferential cut lines 524 is aligned with a radial cut line 518, 520 wherein the radial cut lines 518, 520 define side edges of the teeth 516 such that the radial cut line 518, 520, or a notional extension thereof, bisects a respective one of the plurality of first circumferential cut lines 524.

The article retention structure RT3 comprises a plurality of second circumferential cut lines 522. Each of the plurality of second circumferential cut lines 522 is disposed between a pair of the plurality of first circumferential cut lines 524 and is spaced apart therefrom so as to define a pair of connecting nick or bridge portions between each tooth 516 and the main panel 512. The pair of connecting nick or bridge portions provide a hinged or foldable connection between each tooth 516 and the main panel 512.

In the embodiment of FIG. 6C each of the plurality of second circumferential cut lines 522 is longer in length than the cut defining each of the plurality of first circumferential cut lines 524.

Figure 6D:
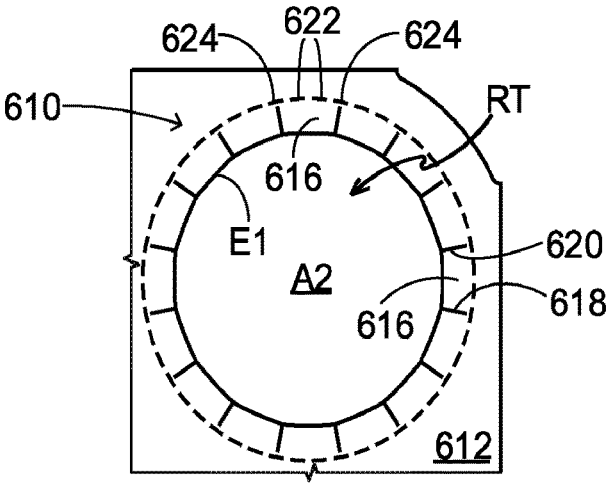

FIG. 6D illustrates a seventh embodiment and shows a portion of a blank 610 for forming an article carrier (not shown).

FIG. 6D shows an article retention structure RT3 comprising an aperture A2 and a plurality of teeth 616 disposed in a main panel 612 of the blank 610 about the aperture A2.

The article retention structure RT3 comprises a plurality of first circumferential cut lines 624. Each of the plurality of first circumferential cut lines 624 is aligned with a radial cut line 618, 620—the radial cut lines 618, 620 define side edges of the teeth 616—such that the radial cut line 618, 620, or a notional extension thereof, bisects a respective one of the plurality of first circumferential cut lines 624.

In the embodiment of FIG. 6D, article retention structure RT3 comprises a plurality of second circumferential cut lines 622. The article retention structure RT3 comprises two second circumferential cut lines 622 disposed between a pair of adjacently disposed ones of the plurality of first circumferential cut lines 624.

Each tooth 616 is hingedly connected to the main panel 612 by a plurality of bridging portions, specifically three bridging portions, located between a pair of adjacently disposed ones of the plurality of first circumferential cut lines 624.

The repeating pattern of first and second cut lines for forming the circular fold line of an article retention structure RT3 may be determined by the angular width of each tooth or tab and/or the number of teeth/tabs forming each retention structure RT3. For example, for a tooth/tab having an angular width of approximately 22.5 degrees—which may be suitable for forming a sixteen-tab retention structure—one of the cut line patterns of FIGS. 1, 3, 4, 6A, 6C and 6D may be optionally used. For a tooth/tab having an angular width of approximately 30 degrees—which may be suitable for forming a twelve-tab retention structure—the cut line pattern of FIG. 6B may be optionally employed.

The present disclosure provides a carrier of the top engaging type having improved article retention structures or article top engaging devices.

There is provided an article carrier 90; 290 having a plurality of top-engaging openings or engaging structures RT1, RT2, RT3 each having an annular series of engaging teeth or tabs 16; 216 along the perimeter of that opening. The annular series of engaging tabs 16; 216 of each opening is interrupted by at most two gaps 26, 26A, 26B. A notional diametrical line z-z' passes through the center of each of the at most two gaps 26, 26A, 26B and extends substantially perpendicular to the grain direction GR of paper material from which the article carrier 90; 290 is formed. In alternative implementations, notional diametrical line z-z' that passes through the center of each of the at most two gaps 26, 26A, 26B may extend substantially parallel to the grain direction GR of paper material from which the article carrier 90; 290 is formed.

The present disclosure also provides an article carrier 90; 290 having a plurality of top-engaging openings or engaging structures RT1, RT2, RT3 each having an annular series of engaging tabs 16; 216 along the perimeter thereof. The annular series of engaging tabs 16; 216 of each opening is interrupted by at most two gaps 26, 26A, 26B. A notional diametrical line z-z' passes through the center of each of the at most two gaps 26, 26A, 26B and extends parallel to a longitudinal axis y of the article carrier 90: 290.

An article carrier 90; 290 is provided which has a plurality of top-engaging openings or engaging structures RT1, RT2, RT3 each having an annular series of engaging tabs 16; 216 along the perimeter of that opening. A first one of the plurality of openings or engaging structures RT1 has only one first gap 26 interrupting the annular series of tabs 16; 216 of the first opening. A second one of the plurality of openings or engaging structures RT2 has only two second gaps 26A, 26B interrupting the annular series of tabs 16; 216 of the second opening. The first gap 26 and the each of the second gaps 26A, 26B are aligned along a notional line z-z' parallel to a longitudinal axis y of the article carrier 90; 290.

The present disclosure also provides an article carrier 90; 290 comprising a main panel 12; 112; 212; 312; 412; 512; 612. The main panel 12; 112; 212; 312; 412; 512; 612 comprises at least one top-engaging opening or engaging structure RT1, RT2, RT3 for receiving a portion of an article B. The main panel 12; 112; 212; 312; 412; 512; 612 further comprises an annular series of engaging tabs 16; 116; 216; 316; 416; 516; 616 formed around the at least one opening or engaging structure RT1, RT2, RT3. An aperture A1, A2, A3, A4, A5, A6, A7, A8 defines a first edge E1 of each of the tabs 16; 116; 216; 316; 416; 516; 616 of the annular series. The tabs 16; 116; 216; 316; 416; 516; 616 of the annular series are hingedly connected to the main panel 12; 112; 212; 312; 412; 512; 612 such that the tabs of the annular series yield out of the plane of the main panel 12; 112; 212; 312; 412; 512; 612 when an article B is received in the at least one opening or engaging structure RT1, RT2, RT3. The tabs 16; 116; 216; 316; 416; 516; 616 of the annular series bear against the article B. At least one of the tabs 16; 116; 216; 316; 416; 516; 616 of the annular series is defined at least in part by a first cutline 18; 118; 218; 318; 418; 518; 618 extending from the aperture A1, A2, A3, A4, A5, A6, A7, A8 into the main panel 12; 112; 212; 312; 412; 512; 612. The first cutline 18; 118; 218; 318; 418; 518; 618 separating at least a portion of the at least one of the tabs 16; 116; 216; 316; 416; 516; 616 from an adjacent one of the tabs 16; 116; 216; 316; 416; 516; 616 of the annular series. The main panel 12; 112; 212; 312; 412; 512; 612 further comprises a second cutline 24; 124; 324; 424; 524; 624. The second cutline 24; 124; 324; 424; 524; 624 defines a portion of a second edge of each of the at least one of the tabs 16; 116; 216; 316; 416; 516; 616 of the annular series and the adjacent one of the tabs 16; 116; 216; 316; 416; 516; 616 of the annular series. The second edge opposes the first edge E1 of each of the at least one of the tabs 16; 116; 216; 316; 416; 516; 616 of the annular series and the adjacent one of the tabs 16; 116; 216; 316; 416; 516; 616 of the annular series.

The second cutline 24; 124; 324; 424; 524; 624 may be linear.

The second cutline 24; 124; 324; 424; 524; 624 may be arcuate in shape. The second cutline 24; 124; 324; 424; 524; 624 may be defined by a radius of curvature having a center thereof coincidental with the center of the aperture A1, A2, A3, A4, A5, A6, A7, A8.

The at least one of the tabs 16; 116; 216; 316; 416; 516; 616 of the annular series may be connected to the adjacent one of the tabs 16; 116; 216; 316; 416; 516; 616 by a connecting portion P1 proximate the second cutline 24; 124; 324; 424; 524; 624.

The main panel 12; 112; 212; 312; 412; 512; 612 may further comprise at least one third cutline 22; 122; 322; 422; 522; 622 spaced apart from the second cutline 24; 124; 324; 424; 524; 624. The at least one third cutline 22; 122; 322; 422; 522; 622 defines a portion of a hinged connection of each of the at least one of the tabs 16; 116; 216; 316; 416; 516; 616 of the annular series. The hinged connection opposes the first edge E1 of each of the at least one of the tabs 16; 116; 216; 316; 416; 516; 616 of the annular series. The at least one third cutline 22; 122; 322; 422; 522; 622 may be straight or arcuate in shape.

The at least one third cutline 22; 122; 322; 422; 522; 622 comprises a series of two or more cuts spaced apart from one another.

It will be recognized that as used herein, directional references such as "top", "bottom", "base", "front", "back", "end", "side", "inner", "outer", "upper" and "lower" do not necessarily limit the respective panels to such orientation, but may merely serve to distinguish these panels from one another.

As used herein, the terms "hinged connection" and "fold line" refer to all manner of lines that define hinge features of the blank, facilitate folding portions of the blank with respect to one another, or otherwise indicate optimal panel folding locations for the blank. Any reference to "hinged connection" should not be construed as necessarily referring to a single fold line only; indeed a hinged connection can be formed from two or more fold lines wherein each of the two or more fold lines may be either straight/linear or curved/curvilinear in shape. When linear fold lines form a hinged connection, they may be disposed parallel with each other or be slightly angled with respect to each other. When curvilinear fold lines form a hinged connection, they may intersect each other to define a shaped panel within the area surrounded by the curvilinear fold lines. A typical example of such a hinged connection may comprise a pair of arched or arcuate fold lines intersecting at two points such that they define an elliptical panel therebetween. A hinged connection may be formed from one or more linear fold lines and one or more curvilinear fold lines. A typical example of such a hinged connection may comprise a combination of a linear fold line and an arched or arcuate fold line which intersect at two points such that they define a half moon-shaped panel therebetween.

As used herein, the term "fold line" may refer to one of the following: a scored line, an embossed line, a debossed line, a line of perforations, a line of short slits, a line of half-cuts, a single half-cut, an interrupted cutline, a line of aligned slits, a line of scores and any combination of the aforesaid options.

It should be understood that hinged connections and fold lines can each include elements that are formed in the substrate of the blank including perforations, a line of perforations, a line of short slits, a line of half-cuts, a single half-cut, a cutline, an interrupted cutline, slits, scores, embossed lines, debossed lines, any combination thereof, and the like. The elements can be dimensioned and arranged to provide the desired functionality. For example, a line of perforations can be dimensioned or designed with degrees of weakness to define a fold line and/or a severance line. The line of perforations can be designed to facilitate folding and resist breaking, to facilitate folding and facilitate breaking with more effort, or to facilitate breaking with little effort.

The phrase "in registry with" as used herein refers to the alignment of two or more elements in an erected carton, such as an aperture formed in a first of two overlapping panels and a second aperture formed in a second of two overlapping panels. Those elements in registry with each other may be aligned with each other in the direction of the thickness of the overlapping panels. For example, when an aperture in a first panel is "in registry with" a second aperture in a second panel that is placed in an overlapping arrangement with the first panel, an edge of the aperture may extend along at least a portion of an edge of the second aperture and may be aligned, in the direction of the thickness of the first and second panels, with the second aperture.

The invention claimed is:

1. An article carrier for packaging at least one article, the article carrier comprising a main panel having at least one top-engaging opening, each top-engaging opening for receiving a portion of an article and defined at least in part by an aperture struck from the main panel, the main panel comprising a series of engaging tabs formed around the at least one opening, the aperture defining a first edge of each of the tabs of the series, wherein the tabs of the annular series are hingedly connected to the main panel such that the tabs yield out of the plane of the main panel when an article is received in the at least one opening so as to bear against the article, at least one of the tabs of the series is defined at least in part by a first cutline extending from the aperture into the main panel, the first cut-line separates at least a portion of the at least one of the tabs from an adjacent one of the tabs of the series, wherein the main panel comprises a second cut-line defining a portion of a second edge of each of said at least one tab and said adjacent tab, wherein the second edge opposes the first edge, and wherein the second cutline comprises a segment of a notional circle surrounding the aperture, and the second cutline is either linear or arcuate in shape.

2. An article carrier according to claim 1 wherein the second cutline is arcuate in shape, and the second cutline is defined by a radius of curvature having a center thereof coincidental with the center of the aperture.

3. An article carrier according to claim 1 wherein the at least one of the tabs of the series is connected to the adjacent one of the tabs by a connecting portion proximate the second cutline.

4. An article carrier according to claim 1 wherein the main panel comprises at least one third cutline spaced apart from the second cutline, the at least one third cutline defines a portion of a hinged connection between at least one of the tabs of the series and the main panel.

5. An article carrier according to claim 4 wherein the at least one third cutline comprises a series of two or more cuts spaced apart from one another.

6. An article carrier according to claim 1 wherein the at least one top-engaging opening comprises two top-engaging openings each for receiving the portion of a respective article and each defined at least in part by a respective aperture struck from the main panel, each aperture having a width dimension, wherein the second cutline is arcuate in shape, and the second cutline is defined by a radius of curvature which is greater than half the width dimension of the aperture, and wherein the two top-engaging openings are disposed in close proximity to each other.

7. An article carrier according to claim 6 wherein the at least two top-engaging openings are spaced apart from each other by a first distance, the first distance being less than a quarter of the diameter of the at least two top-engaging openings.

8. An article carrier according to claim 6 wherein the at least two top-engaging openings are spaced apart from each other by a first distance, the first distance being less than twice a maximum height dimension of the tabs forming the series about the at least two top-engaging openings.

9. An article carrier according to claim 1, wherein the at least one top-engaging opening comprises a plurality of top-engaging openings, the main panel comprising a series of the engaging tabs formed around each of the plurality of top-engaging openings, wherein the series of engaging tabs of at least one top-engaging opening is interrupted by a gap, wherein each of the at least one top-engaging opening that has its series of engaging tabs interrupted, is interrupted by at most two gaps.

10. An article carrier according to claim 9 wherein each of the tabs of the series comprises a maximum tab width and each of the at most two gaps comprises a maximum gap width, wherein the maximum gap width is greater than the maximum tab width.

11. An article carrier according to claim 9 wherein, a notional diametric line passes through the center of each of the at most two gaps and extends: (i) parallel to a longitudinal axis of the article carrier, (ii) substantially perpendicular to the grain direction of paper material from which the article carrier is formed, or (iii) both parallel to a longitudinal axis of the article carrier and substantially perpendicular to the grain direction of paper material from which the article carrier is formed.

12. An article carrier according to claim 1, wherein the at least one top-engaging opening comprises a plurality of top-engaging openings each having the series of engaging tabs along the perimeter of that opening, wherein a first one of the plurality of openings has only one first gap interrupting the series of tabs of the first opening, and a second one of the plurality of openings has only two second gaps interrupting the series of tabs of the second opening, wherein the first gap and each of the second gaps are aligned along a notional line parallel to a longitudinal axis of the article carrier.

13. An article carrier according to claim 1 wherein the second cutline is linear.

14. An article carrier according to claim 13 wherein the second cutline is aligned with the first cutline such that the first cutline, or a notional extension thereof, bisects the second cutline.

15. An article carrier according to claim 13 wherein the first cutline extends radially outward from a vertex or corner of a polygonal shape forming the aperture.

16. A blank for forming an article carrier, the blank comprising a main panel having at least one top-engaging opening, each top-engaging opening for receiving a portion of an article and defined at least in part by an aperture struck from the main panel, the main panel comprising a series of engaging tabs formed around the at least one opening, the aperture defining a first edge of each of the tabs of the series, wherein the tabs of the series are hingedly connected to the main panel, at least one of the tabs of the series is defined at least in part by a first cutline extending from the aperture into the main panel, the first cut-line separates at least a portion of the at least one of the tabs from an adjacent one of the tabs of the series, wherein the main panel comprises a second cutline defining a portion of a second edge of each of said at least one tab and said adjacent tab, wherein the second edge opposes the first edge, and wherein the second cutline comprises a segment of a notional circle surrounding the aperture, and the second cutline is either linear or arcuate in shape.

17. A blank according to claim 16, wherein the second cutline is arcuate in shape, and the second cutline is defined by a radius of curvature having a center thereof coincidental with the center of the aperture.

18. A blank according to claim 16 wherein the aperture has a width dimension, and wherein the second cutline is arcuate in shape, and the second cutline is defined by a radius of curvature which is greater than half the width dimension of the aperture.

19. A blank according to claim 16 wherein the second cutline is linear.

20. A blank according to claim 19 wherein the second cutline is aligned with the first cutline such that the first cutline, or a notional extension thereof, bisects the second cutline.

21. A blank according to claim 19 wherein the first cutline extends radially outward from a vertex or corner of a polygonal shape forming the aperture.

22. A blank for forming an article carrier, the blank comprising a main panel comprising a plurality of top-engaging openings each having an annular series of engaging tabs formed around each of the plurality of top-engaging openings for engaging with a portion of an article received in each top-engaging opening, wherein the annular series of engaging tabs of at least one top-engaging opening is interrupted by a gap, wherein each of the at least one top-engaging opening that has its annular series of engaging tabs interrupted, is interrupted by at most two gaps.

23. A blank according to claim 22 wherein a notional diametric line passes through the center of each of the at most two gaps and extends: (i) parallel to a longitudinal axis of the blank, (ii) substantially perpendicular to the grain direction of paper material from which the blank is formed, or (iii) both parallel to a longitudinal axis of the blank and substantially perpendicular to the grain direction of paper material from which the blank is formed.

24. A blank according to claim 22 wherein a first one of the plurality of openings has only one first gap interrupting the annular series of tabs of the first opening, a second one of the plurality of openings has only two second gaps interrupting the annular series of tabs of the second opening, the first gap and each of the second gaps are aligned along a notional diametrical line, wherein the notional diametrical line is parallel to a longitudinal axis of the blank.

* * * * *